US005789747A

United States Patent [19]

Kato et al.

[11] Patent Number: 5,789,747

[45] Date of Patent: Aug. 4, 1998

[54] THREE DIMENSIONAL QUADRUPOLE MASS SPECTROMETRY AND MASS SPECTROMETER

[75] Inventors: Yoshiaki Kato, Mito; Tadao Mimura, Hitachinaka, both of Japan

[73] Assignee: Hitachi, Ltd., Tokyo, Japan

[21] Appl. No.: 859,657

[22] Filed: May 20, 1997

[30] Foreign Application Priority Data

May 21, 1996 [JP] Japan ..... 8-125523

[51] Int. Cl.[6] ..... H01J 49/42

[52] U.S. Cl. ..... 250/292; 250/282

[58] Field of Search ..... 250/292, 282

[56] References Cited

U.S. PATENT DOCUMENTS

| | | | |
|---|---|---|---|
| 2,939,952 | 6/1960 | Wolfgang et al. | 250/41.9 |
| 3,527,939 | 9/1970 | Dawson et al. | 250/41.9 |
| 4,540,884 | 9/1985 | Stafford et al. | 250/282 |
| 4,771,172 | 9/1988 | Weber-Grabau et al. | 250/282 |
| 5,107,109 | 4/1992 | Stafford, Jr. et al. | 250/282 |
| 5,302,827 | 4/1994 | Foley | 250/292 |
| 5,479,012 | 12/1995 | Wells | 250/282 |
| 5,572,022 | 11/1996 | Scwartz et al. | 250/282 |

FOREIGN PATENT DOCUMENTS 486516 2/1973 Japan .

60-32310 7/1985 Japan .

*Primary Examiner*—Jack I. Berman

*Attorney, Agent, or Firm*—Kenyon & Kenyon

[57] ABSTRACT

In a three dimensional quadrupole mass spectrometry, ions created in an ion source 1 are introduced into a three dimensional quadrupole field 7 formed in an ion introduction space and trapped therein. When one or more parameters of the three dimensional quadrupole field is scanned, the ions of which oscillation are instablized are successively discharged to the outside thereof and are detected by a detector 12. The signal representing the detected ions is processed by a data processing unit 13 to determine mass spectrum thereof. Prior to the above mass spectrometry, a preliminary measurement for the created ions is performed by detecting the ions passing through the ion introduction space as they are with no influences therefrom within a predetermined period by the detector 12 and a time interval during which the created ions are to be introduced into the ion introduction space for the mass spectrometry is determined based on the detected ion amount in the preliminary measurement. Thereby, the measurement time by the three dimensional quadrupole mass spectrometry is shortened while preventing ion saturation and space charge caused by the ions.

7 Claims, 4 Drawing Sheets

THREE DIMENSIONAL QUADRUPOLE MASS SPECTROMETRY AND MASS SPECTROMETER

BACKGROUND OF THE INVENTION

1. Field of the Invention

The present invention relates to a three dimensional quadrupole mass spectrometry and mass spectrometer and, in particular, relates to a three dimensional quadrupole mass spectrometry and mass spectrometer which are suitable for increasing sensitivity and dynamic range thereof.

2. Description of Conventional Art

Three dimensional quadrupole mass spectrometry is sometimes called as ion trap mass spectrometry, of which details are explained such as in JP-B-48-6516(1973), JP-B-60-32310 (1985) and U.S. Pat. Nos. 2,939,952 and 3,527,939. In this type of mass spectrometers, after ions having different masses are once and simultaneously trapped within a three dimensionally formed quadrupole field, the ions are caused to be ejected to the exterior according to every mass of the ions by scanning the quadrupole field and there ejected ions are detected to obtain mass spectrum thereof.

Many methods are proposed through which mass spectrum of a sample can be obtained.

In the method disclosed in JP-B-60-32310 (1985) and U.S. Pat. No. 4,540,884, after once and simultaneously trapping ions having a wide range of masses in a three dimensional quadrupole field, one or more of parameters of the quadrupole field are scanned. Thereby, ion trajectories for every mass in the quadrupole field are successively instabilized and the ions are successively ejected outside the quadrupole field of which method is called as Mass Selective Instability. In this method, it is a precondition to produce ions inside or outside the quadrupole field and to trap once the produced ions inside the quadrupole field. In case of a GC/MS device in which a gas chromatograph (GC) serving as a separating device for a sample to be analyzed is directly coupled to a mass spectrometer (MS) at the pre-stage thereof, components separated by the GC are introduced into the space defined by the electrodes of the three dimensional quadrupole of the ion trap type MS, then thermal electrons are injected from the outside to the inside of the space defined by the electrodes of the three dimensional quadrupole and are caused to collide to sample molecules to produce ions thereof. Thus produced ions are trapped in the quadrupole field through formation of respective stable ion trajectories therein by application of a high frequency voltage of about 1 MHz on a ring electrode forming the quadrupole field in combination. The trapped ions are an aggregation of ions having different masses and the respective ions are stably trapped in the quadrupole field while repeating respective secular motions corresponding to the respective masses of the ions.

However, when the number of trapped ions increases, ions having same polarity repulse each other and the secular motion of which each ion possesses is affected. As a result, the affected ion performs different motion from the secular motion of which the affected ion inherently possesses. If a parameter of the quadrupole field is scanned under such condition, the apparent detected mass of such ions is deviated, the resolution of the mass peak is deteriorated and the mass spectrum of which ion quantity looks like to be suppressed is obtained. These occurrences are due to induced space charge in the quadrupole field. Under this condition, neither the correct mass spectrum of the introduced component nor the correct ion current proportional to the amount of introduced component can not be obtained. Therefore, under this condition it is understood that the ion trap type MS can not be used as a qualitative and quantitative analysis means, namely can not perform the function required for a MS. In the ion trap type MS, these space charge and ion saturation narrow the dynamic range and disturb parctical GC/MS analysis.

In order to eliminate these adverse effects, two methods are proposed. In both methods, one scan cycle is divided into two steps at first through preliminary ionization amount of ions is measured. Based on the measured ion amount an ionization time for the subsequent principal analysis scan is determined so as not to cause such space charge. After performing the ionization according to the determined ionization time, the quadrupole field is scanned to thereby obtain mass spectrum of the sample components introduced. After completing the preliminary scan and the subsequent principal analysis scan, the ion amount is normalized by a CPU.

U.S. Pat. No. 4,771,172 discloses the following GC/MS analysis method in which Chemical Ionization (CI) is used for ionizing ions. In CI, a great amount of reagent gas such as methane gas and ammonia gas is introduced into an ion source together with sample molecules to ionize the reagent gas and the sample molecules through collision of thermal electrons. At first the reagent gas existing in great quantity is ionized, thereafter, highly reactive reagent ions are created through ion molecule reaction between the created reagent gas ions and the reagent gas molecules. Finally, sample ions are created through collision reaction or ion molecule reaction between the reagent ions and sample molecules. Different from Electron Ionization (EI), ions created by IC are soft ions, therefore, CI used for analyzing chemical compounds of which molecule ions can not be obtained by EI. In this CI, the amount of sample ion creation is controlled by controlling the length of the ion molecule reaction time. The CI is explained with reference to FIG. 3.

Preliminary Measurement or Prescan

Through electron collision and ion molecule reaction during a predetermined ionization time $T_2$-$T_1$, chemically ionized reagent ions are created within a three dimensional quadrupole field. Thus created reagent ions and the sample molecules are reacted for a predetermined time $T_3$-$T_2$ to ionize the sample molecules. Thereafter, the three dimensional quadrupole field is reset, the sample ions are ejected outside and the Total Ion Current (TIC) thereof is measured.

Principal Analysis Scan

Based on the amount of the measured TIC the ion molecule reaction time $T_6$-$T_5$ or ionization time $T_5$-$T_4$ in the following principal analysis scan is determined, thereby, CI mass spectrum having a high sensitivity and a broad dynamic range is obtained.

When the intensity of the TIC in the prescan period is high, the reaction time is shortened. On the other hand, when the intensity of the TIC in the prescan period is low, the reaction time is elognated to create many ions. Since the obtained mass spectrum is normalized afterward by a CPU depending upon the reation time, the normalized mass spectrum correctly reflects the actual amount of introduced sample.

U.S. Pat. No. 5,107,109 discloses another GC/MS analysis method using Electron Ionization (EI) and for increasing the dynamic range. The method is explained with reference to FIG. 4. During prescan period electrons are introduced into the three dimensional quadrupole field for a predetermined time $T_8$-$T_7$ to ionize the sample molecules within the quadrupole field. Thereafter, by varying one or more parameters of the quadrupole field ions therein are ejected to the outside and the TIC of the ejected ions is measured. Based on the measured TIC, the ionization time $T_{10}$-$T_9$ or the amount of ionization current in the following principal analysis scan is controlled so as not to cause space charge in the quadrupole field.

The GC/MC analysis disclosed in U.S. Pat. Nos. 4,771,172 and 5,107,109 requires a predetermined time for ionization in the prescan period in order to obtain TIC. $T_2$-$T_1$ in FIG. 3 and $T_8$-$T_7$ in FIG. 4 correspond to the ionization time. Thereafter either by resetting or by scanning the three dimensional quadrupole field the TIC is measured. For conducting these preliminary measurements about 10 msec is required. This measurement time is an excessive time added to the following principal analysis scan time. Thereby, the actual measurement time in a unit sample analysis time is relatively reduced.

Further, the ionization time in a prescan period is constant during series of one analysis on a sample concerned. Namely, $T_2$-$T_1$ and $T_3$-$T_2$ in FIG. 3 example and $T_8$-$T_7$ in FIG. 4 example are respectively predetermined constant time. For this reason, if ions saturate or space charge is caused in these predetermined constant times, correct measurement is suffered. In order to prevent this difficulty, it is required to estimate the amount of sample to be introduced and to determine beforehand the ionization time in the preliminary measurement or the prescan period, in that if it is estimated that the amount of sample to be introduced is little and possibility of saturation is low, the ionization time is set to be long, on the other hand, if it is estimated that the amount of sample to be introduced is much, the ionization time is set to be short, and thereafter based on the set ionization time in the preliminary measurement, respective ionization times in the following principal analysis scan is determined.

However, such estimation is totally impossible in actual measurement. Therefore, in practice, the ionization time in the preliminary measurement is set at a fix period.

SUMMARY OF THE INVENTION

An object of the present invention is to provide a three dimensional quadrupole mass spectrometry and mass spectrometer which is suitable for preventing ion saturation and space charge by ions and shortens the measurement time.

A three dimensional quadrupole mass spectrometry and mass spectrometer according to the present invention in which sample components are ionized, the ionized ions are subjected to mass spectrometry in a three dimensional quadrupole field formed in a predetermined space and the ions subjected to the mass spectrometry are detected to thereby obtain mass spectrum of the sample components, characterized in that prior to subjecting the ions to the mass spectrometry, the ions are passed through the predetermined space set to a condition which permits the ions to pass therethrough and without being affected thereby, the amount of the ions thus passed therethrough is detected, and a time period during which the ions are introduced in the predetermined space for the mass spactrometry is determined based on the amount of ions detected.

DETAILED DESCRIPTION OF THE PREFERRED EMBODIMENT

Figure 1:
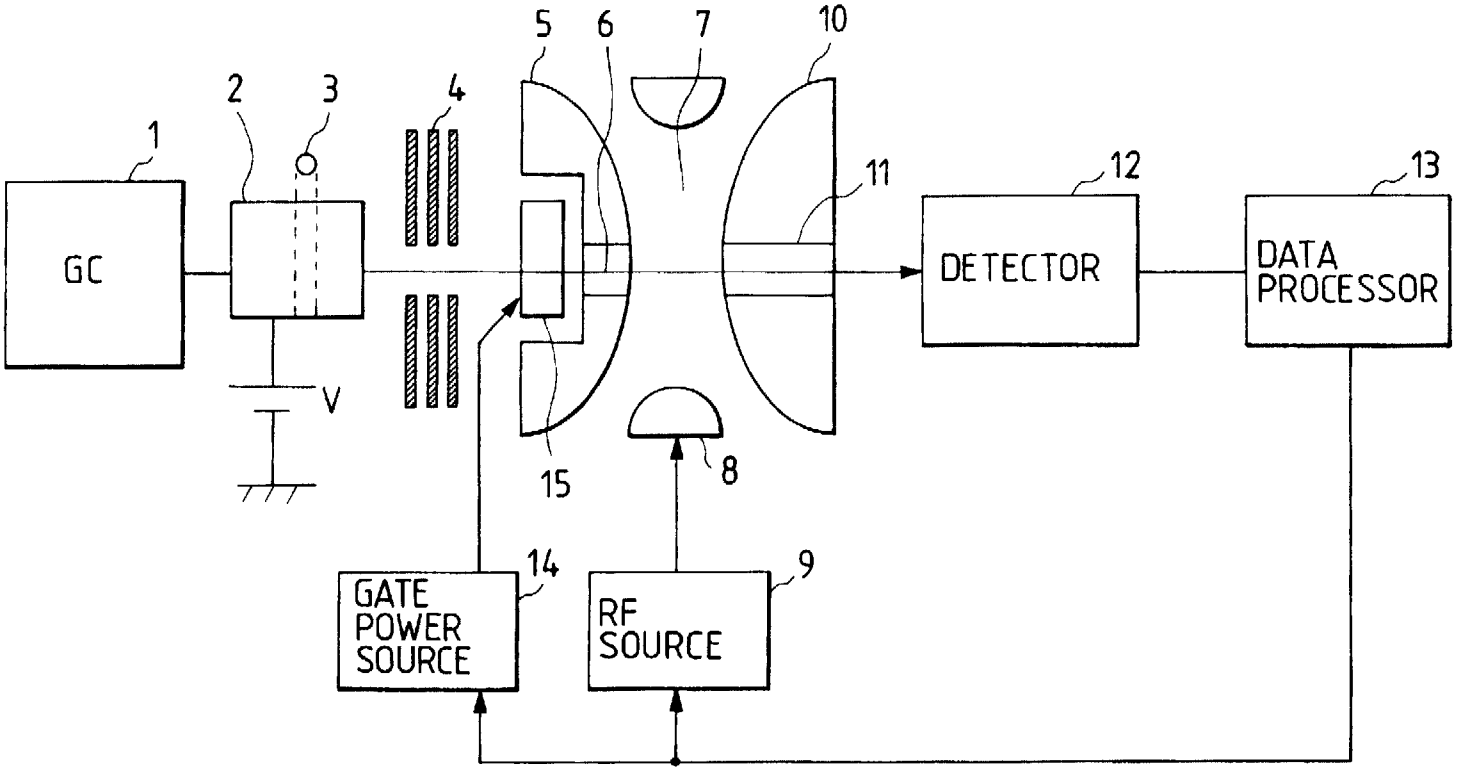
FIG. 1 is a schematic diagram of a three dimensional quadrupole mass spectrometer representing one embodiment according to the present invention.

In the one embodiment according to the present invention as shown in FIG. 1, respective sample component molecules separated in every component by a gas chromatography (GC) are introduced into an ion source 2 together with carrier gas such as He gas. In the ion source 2 the sample component molecules are ionized by electrons emitted from a filament 3. Thus created ions are ejected from the ion source 2, focused by a lens 4, pass through an inlet aperture 6 formed along the rotation center axis of an end cap electrode 5 in three quadrupole electrodes and reach to a three dimensional quadrupole field 7 formed in an ion introduction space. A ring electrode 8 is applied of a voltage having a high frequency Rf supplied from a high frequency power source 9. On the other hand, two end cap electrodes 5 and 10 are provided with the ground potential. Because of the application of the voltage having high frequency Rf onto the ring electrode 8, the three dimensional quadrupole field 7 is formed in the ion introduction space formed by the end cap electrodes 5 and 10 and the ring electrode 8. Therefore, the injected ions are trapped in the space defined by the electrodes. When the amplitude of the high frequency voltage supplied from the high frequency power source 9 is gradually increased, in other words scanned, respective ions gradually increase vibration amplitudes in the order from ones having smaller mass in Z axis direction (along the direction when ions are injected, in other words, central axis direction of the two end cap electrodes 5 and 10). Finally the respective ions are discharged outside from the apertures 6 and 11 of the end cap electrodes 5 and 10. These discharged ions are detected by a detector 12 located backward of the end cap electrode 10 and then the mass spectrum thereof is obtained by a data processing unit 13.

When positive ions from the external ion source are injected through the inlet aperture 6 while maintaining the end cap electrodes 5 and 10 at the ground potential and applying negative voltage of about 10 V onto the ring electrode 8, the ion introduction space functions as a space which permits to pass such ions as they are without causing any influences thereon, therefore, the ions pass through the inlet aperture 6 of the end cap electrode 5, the ring electrode 8 and the inlet aperture 11 of the end cap electrode 10 and reach to the detector 12. Accordingly, the amount of ions created in the ion source 2 is detected and measured in real time by the detector 12. The measurement period of about 1 msec is sufficient for the measurement of the ion amount. Under this condition since no ions are trapped in the three dimensional quadrupole field 7 formed in the ion introduction space, no influences due to space charge are induced. Herein it is assumed that the measured ion current is $I_1$ and further assumed that a predetermined current limit stored in a CPU which causes neither space charge nor ion saturation is $I_0$.

Now, the operation moves to the step for obtaining mass spectrum by introducing the ions in the quadrupole field. Herein, ion trapping time $T_1$ after the ion introduction is determined by the following equation;

$$T_1=T_0\times I_0/I_1$$

wherein, $T_0$ indicates the maximum time in which ions represented by the current $I_0$ can be introduced into the three dimensional quadrupole field with no space charge. According to the above equation, the ion introduction time $T_1$ is automatically determined through the measurement of the ion current value $I_1$ in the preliminary measurement. A control signal representing the determined ion introduction time $T_1$ is transmitted from the data processing unit 13 via an ion introduction gate power source 14 to the ion introduction gate 15. When introducing positive ions, the ion introduction gate 15 is applied of negative voltage of about 100 V. When introducing negative ions, the applied voltage polarity on the ion introduction gate 15 is reversed. When no ions are introduced into the three dimensional quadrupole field the ion introduction gate 15 is applied of positive voltage of about 100 V.

During the principal analysis scan the ring electrode 8 is applied of a voltage of high frequency Rf from the high frequency source 9. During the time period $T_1$ ions are introduced and trapped in the three dimensional quadrupole field 7. When the time period $T_1$ has passed a positive voltage of about 100 V is applied on the ion introduction gate 15. Thereby, the introduction of ions into the three dimensional quadrupole field 7 is terminated. Thereafter, scanning of the quadrupole field is performed while varying the amplitude of the applied voltage having a high frequency Rf on the ring electrode 8 from the high frequency power source 9, thereby the ions from ones having light mass to ones having heavy mass are successively unstabilized in the Z axis direction and the respective unstabilized ions are discharged from the ejecting aperture 11 of the end cap electrode 10. The ejected ions are detected by the detector 12 and the mass spectrum thereof is obtained by the data processing unit 13.

Figure 2:
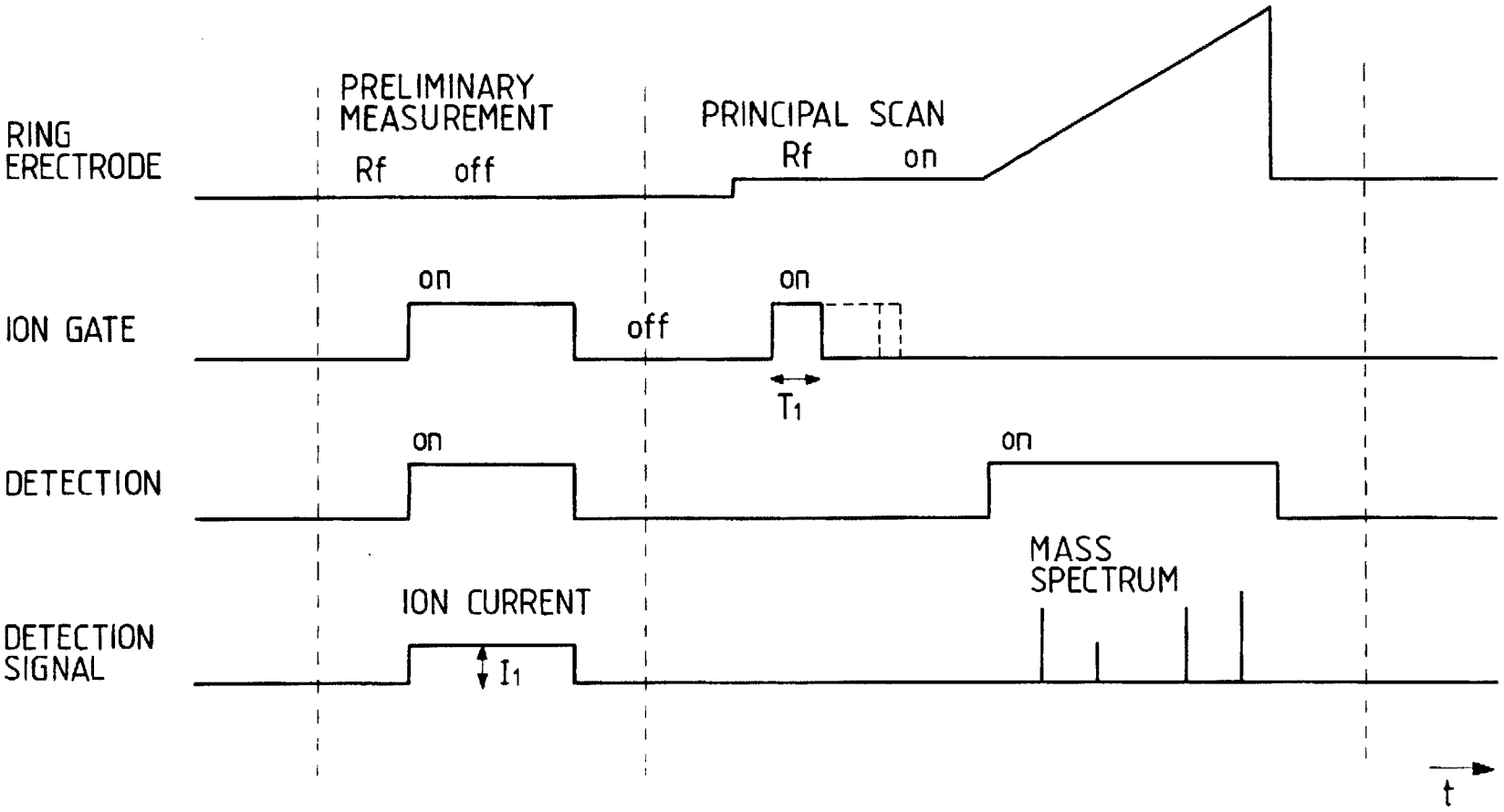
FIG. 2 is a diagram for explaining timings of major operations in the mass spectrometry as shown in FIG. 1.
Figure 3:
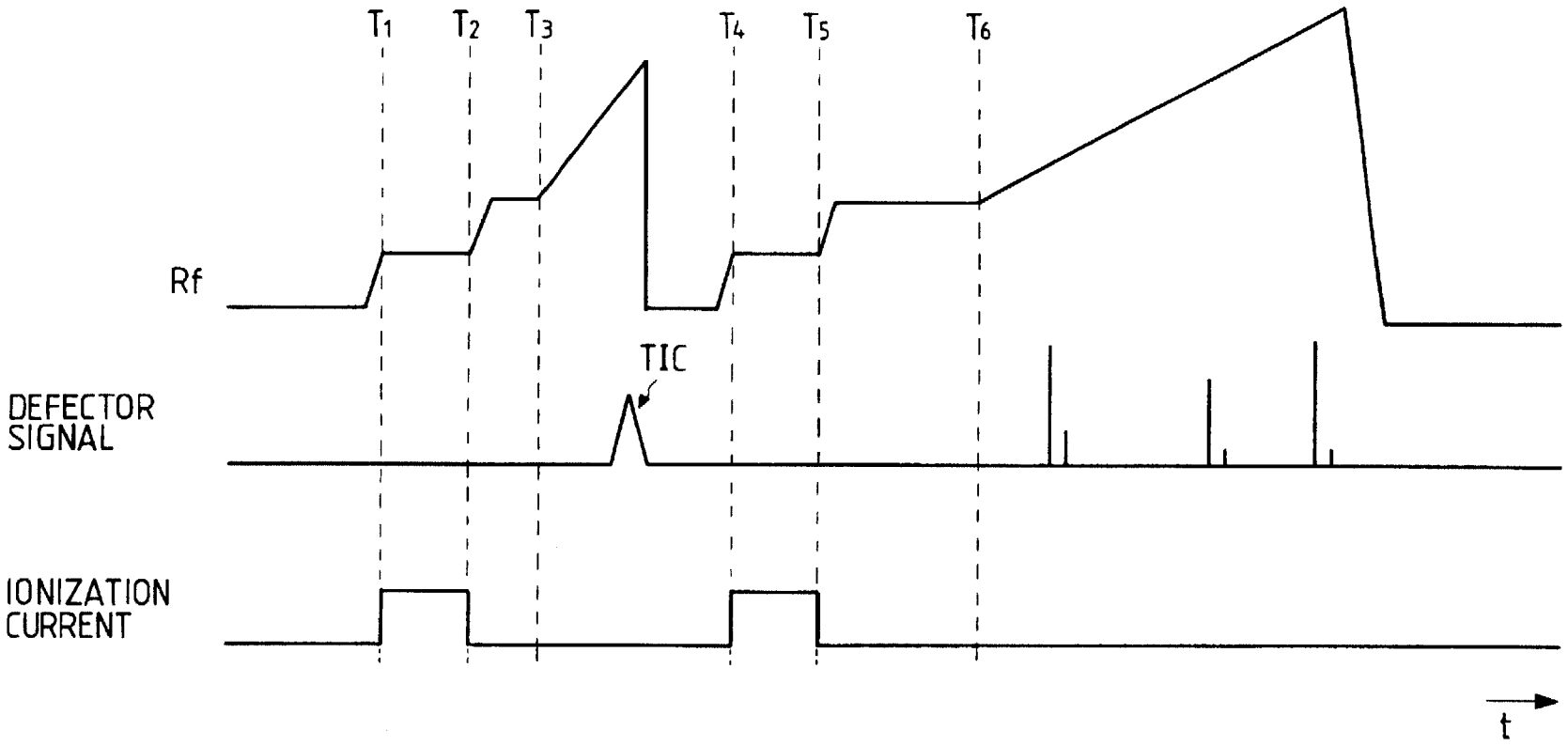
FIG. 3 is a diagram for explaining timings of major operations in a conventional mass spectrometry using CI.
Figure 4:
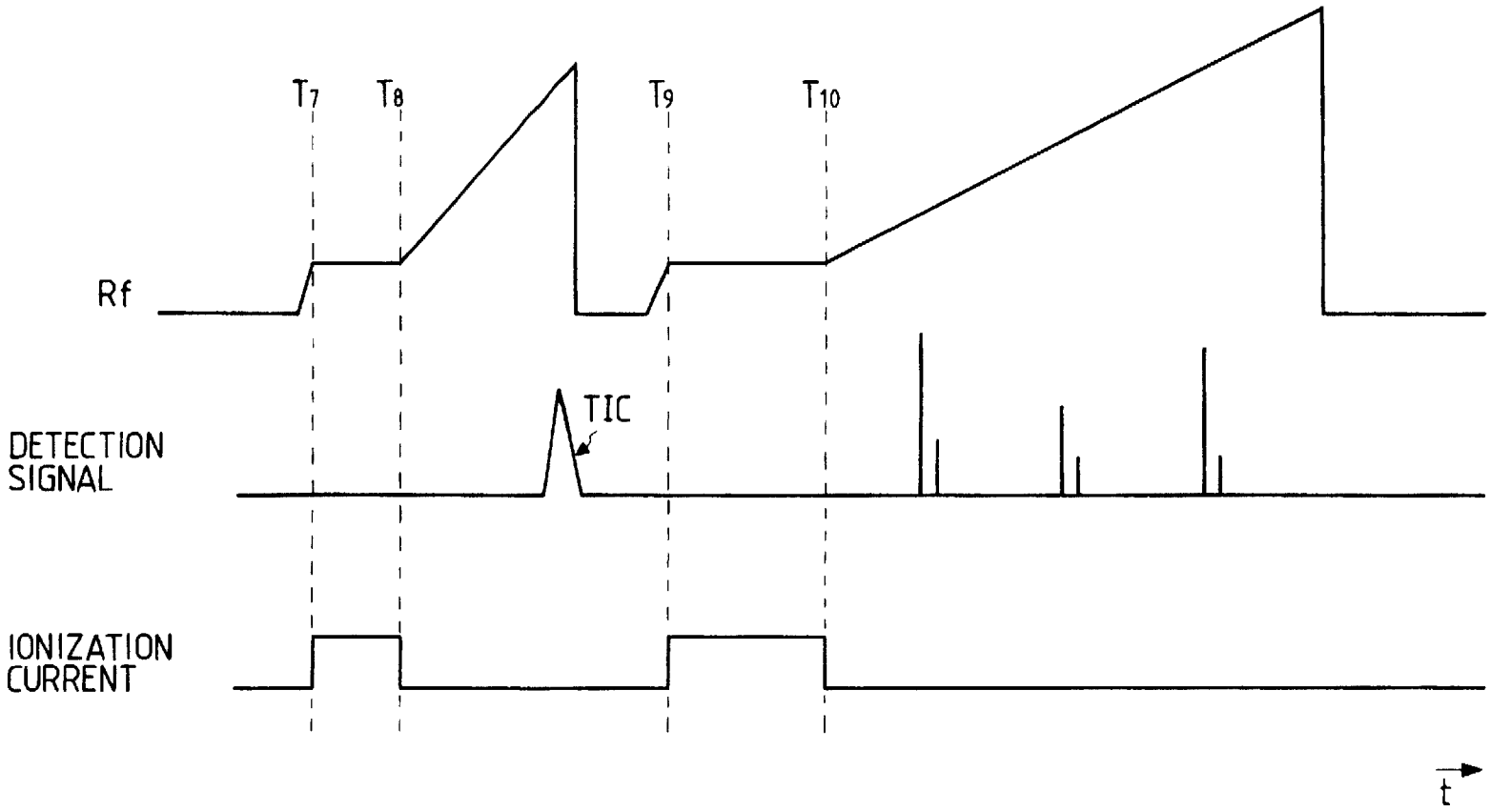
FIG. 4 is a diagram for explaining timings of major operations in a conventional mass spectrometry using EI.

FIG. 2 illustrates the timing chart of the above explained major operations.

In the embodiment according to the present invention, during the preliminary measurement all of the ions created in the ion source 2 are directly. measured without being affected by the quadrupole field 7. Therefore, a broad dynamic range such as $10^5$ is achieved, which eliminates possibility of the saturation during the preliminary measurement as well as necessity of determining the ionization time after estimating in advance the amount of sample components to be introduced.

With the present invention, the time period for the preliminary measurement is shortened, thereby the total scan cycle time including the preliminary measurement and the pricipal analysis scan is shortened. Accordingly, the number of data samplings in a unit time can be increased which permits the follow-up operation to a chromatogram varying in a high speed which corresponds to an increased amount of sample flowing-in into an ion source. Further, ion saturation during the preliminary measurement is prevented, samples having wide range of concentration from high concentration to low concentration can be measured, in other words, the dynamic range of the present mass spectrometer is increased. Further, the manipulation of the present mass spectrometer is simplified, in that, when the concentration of the sample to be analyzed is low, the ionization time is prolonged to permit a high sensitivity measurement and the fixed ion current measurement time during the preliminary measurement is permitted.

According to the present invention a three dimensional quadrupole mass spectrometry and mass spectrometer is provided which is suitable for preventing ion saturation and space charge by ions in a three dimensional quadrupole field and shortens the measurement time.

What is claimed is:

1. A three dimensional quadrupole mass spectrometry in which sample components are ionized, the ionized ions are subjected to mass spectrometry in a three dimensional quadrupole field formed in a predetermined space and the ions subjected to the mass spectrometry are detected to thereby obtain mass spectrum of the sample components, wherein prior to subjecting the ions to the mass spectrometry, the ions are passed through the predetermined space set to a condition which permits the ions to pass therethrough and without being affected thereby, the amount of the ions thus passed therethrough in a predetermined period is detected and a time period during which the ions are introduced in the predetermined space for the mass spectrometry is determined based on the amount of ions detected, and the ions are introduced into the three dimensional quadrupole field for the determined time period so as to perform mass spectrometry.

2. A three dimensional quadrupole mass spectrometer comprises:

a first means for ionizing sample components;

a second means for subjecting the ionized sample components from said first means to mass spectrometry; and a third means for detecting the ionized sample components subjected to mass spectrometry in said second means, said second means includes an ion introduction space, said ion introduction space serves, when performing a preliminary measurement for the ionized sample components, as a space which permits to pass the ionized sample components as they are and forms, when performing mass spectrometry for the ionized sample components, a three dimensional quadrupole field.

3. A three dimensional quadrupole mass spectrometer according to claim 2 further comprising;

a fourth means for controlling said second means, said fourth means determines a time interval which permits introduction of the ionized sample components into said ion introduction space for performing the mass spectrometry based on the output from said third means determined during the preliminary measurement of the ionized sample components, and controls said second means based on the determined time interval so as to subject the ionized sample components to mass spectrometry.

4. A three dimensional quadrupole mass spectrometry according to claim 3, wherein said second means includes a pair of end cap electrodes each having aperture through which the ionized sample components pass, said pair of end cap electrodes are arranged along the travelling direction of the ionized sample components and faced each other and a ring electrode arranged between said pair of end cap electrodes, and the three dimensional quadrupole field is formed in said ion introduction space by said pair of end cap electrodes and said ring electrode.

5. A three dimensional quadrupole mass spectrometry comprising the steps of;

ionizing sample components to be subjected to mass spectrometry;

detecting the amount of ionized sample components passing through inactivated three dimensional quadrupole field for a predetermined period to determine an ion current caused by the passed ionized sample components;

determining a time interval during which the ionized sample components are introduced into activated three dimensional quadrupole field based on the determined ion current;

subjecting the ionized sample components trapped in the activated three dimensional field to mass spectrometry; and detecting the respective ionized sample components subjected to the mass spectrometry to determine mass spectrum thereof.

6. A three dimensional quadrupole mass spectrometry according to claim 5, wherein the predetermined period for passing the ionized sample components through the inactivated three dimensional quadrupole field is about 1 msec.

7. A three dimensional quadrupole mass spectrometry according to claim 5, wherein the time interval during which the ionized sample components are introduced into the activated three dimensional quadrupole field is determined to be inversely proportional to the determined ion current.

* * * * *